United States Patent [19]

Miller

[11] 4,355,669

[45] Oct. 26, 1982

[54] APPARATUS FOR CANNING FOOD

[76] Inventor: James H. Miller, P.O. Box 623, Eastpoint, Fla. 32328

[21] Appl. No.: 180,922

[22] Filed: Aug. 25, 1980

[51] Int. Cl.[3] ..... B65B 43/42

[52] U.S. Cl. ..... 141/147; 141/152; 141/158; 222/307

[58] Field of Search ..... 222/424.5–457, 222/305, 307; 141/156–162, 135–152

[56] References Cited

U.S. PATENT DOCUMENTS 2,540,259 2/1951 Haugen ..... 222/307
2,910,212 10/1959 Kerr ..... 222/307 X
3,217,944 11/1965 Bell et al. ..... 222/438
3,403,825 10/1968 Modjeski ..... 222/438

*Primary Examiner*—Frederick R. Schmidt
*Attorney, Agent, or Firm*—Walter G. Finch

[57] ABSTRACT

The invention is an improved apparatus for canning food, such as oysters and other foods. The invention consists of a holding tank containing a reservoir of food to be canned, a plurality of combinations of funnel members and quantity measuring structures that cooperate as part of a rotating mechanism to receive measured quantities of food from the holding tank, and at a subsequent indexed point automatically discharge the food into a container. Devices are included for adjusting the mechanism to receive and measure a plurality of quantities of food for a range of sizes of containers.

6 Claims, 15 Drawing Figures

APPARATUS FOR CANNING FOOD

BACKGROUND AND SUMMARY OF THE INVENTION

The invention relates to food canning equipment and in particular to devices for measuring quantities to be placed into cans. Specifically, it relates to automatic equipment that measures a predetermined specific amount of food received from a reservoir of the food, and then automatically discharges the measured amount of food into a container.

In the prior art numerous disadvantages exist in horizontal rotary packaging machines, particularly canning machines. The problems concerned the slowness of the operation, the considerable amount of manual labor required in the process, the need for improved sanitation, and various hazards that involved the safety of operators. The present invention overcomes these problems.

The invention described herein is particularly suited to canning shucked oysters, but it is to be understood that it is within the scope and intent of this invention to canning other foods as well.

In reference to the canning of shucked oysters, the present invention as an adjunct to existing horizontal rotary packaging machines, and particularly in regard to canning oysters, will save considerable time because of the rapidity with which it measures and discharges measured quantities, eliminates the current general requirement of oyster packing in the proximity of boat docking areas. Thus, foods such as oysters or other perishables can be transported in bulk more economically to distant markets and containerized locally.

It is, therefore, an object of the invention to provide an apparatus for canning food that carries a reservoir of food to be canned.

It is another object of the invention to provide an apparatus for canning food that automatically measures a predetermined quantity of food received from a reservoir of food and subsequently discharges it into a container.

It is also an object of the invention to provide an apparatus for canning food that can be adjusted to a plurality of positions to measure a plurality of predetermined quantities of food to be canned.

It is still another object of the invention to provide an apparatus for canning food that can be easily disassembled for cleaning and meeting sanitation measures.

It is yet another object of the invention to provide an apparatus for canning food that can have the mechanism parts and components adjusted to a plurality of positions so that the apparatus can be cleaned easily to meet sanitation measures.

It is also another object of the invention to provide an apparatus for canning food that has improved safety built into the operation to protect the operator.

Further object and advantages of the invention will become more apparent in the light of the following description of the preferred embodiment.

DESCRIPTION OF THE PREFERRED EMBODIMENT

Figure 1:
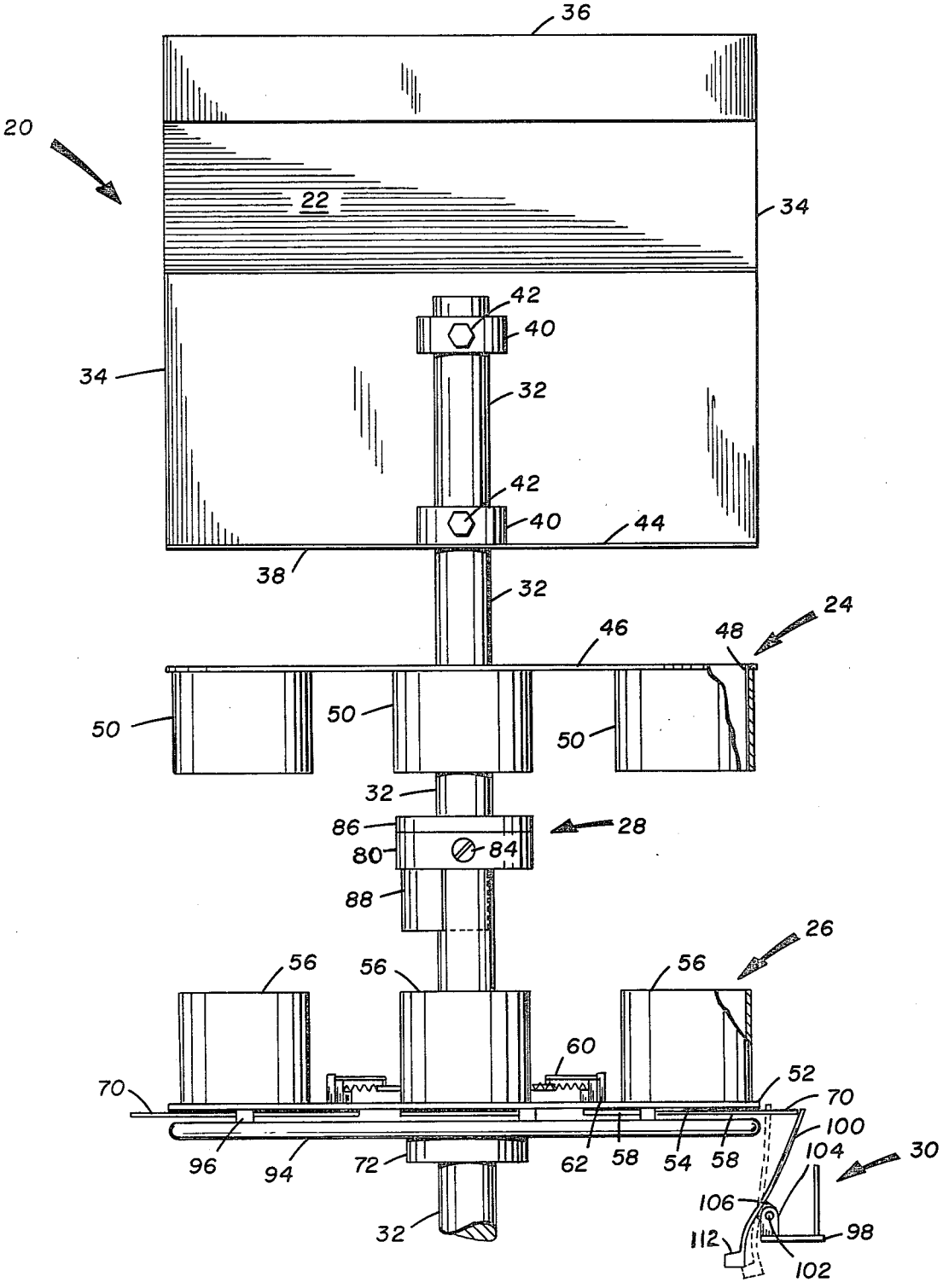
FIG. 1 is a front view of an assembled apparatus for canning food, showing major components in a separated relation to each other on a central support member.

Referring to the drawings and particularly to FIG. 1, an improved apparatus for canning food is shown at 20. The apparatus for canning food 20 consists of the following major components: a reservoir or hopper 22 for food to be canned; an upper plate and funnel system component 24; a lower plate and measuring and discharge or dispensing system 26; upper plate locator and safety control component 28; trigger mechanism component 30; and a central assembly and support means 32 for the reservoir 22 and the aforementioned components 24, 26, and 28. The elements of reservoir 22 and the components 24, 26, 28, and 30 are described hereinafter.

Figure 2:
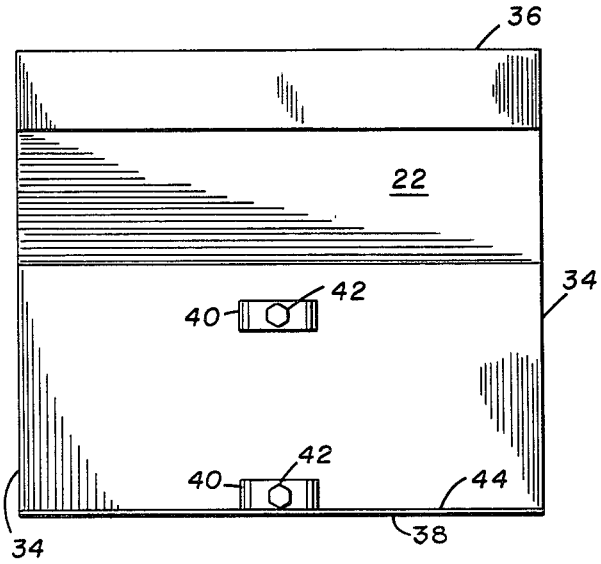
FIG. 2 is a front of a reservoir of an apparatus for canning food.
Figure 3:
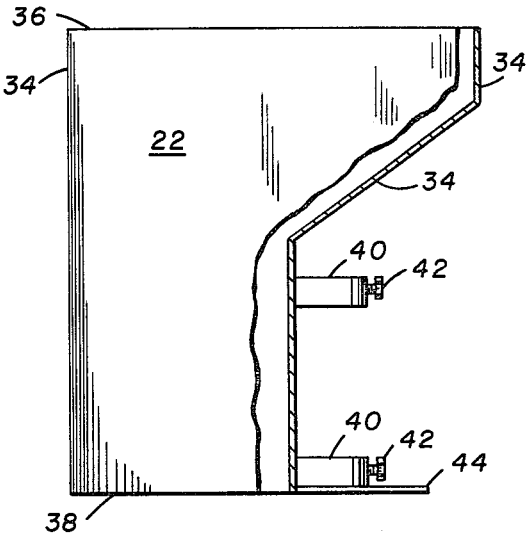
FIG. 3 is a side view of FIG. 2.
Figure 4:
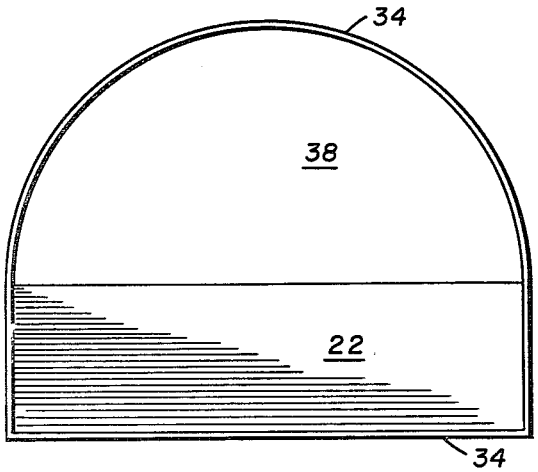
FIG. 4 is a top view of FIG. 2.

Turning now to FIGS. 1, 2, 3, and 4, the reservoir 22 in FIG. 1 is shown in front view in FIG. 2, side view in FIG. 3, and top or plan view in FIG. 4. Note that the configuration shown is semi-circular-like for approximately one-half of the volumetric shape and somewhat like a partially truncated rectangular prism for the other half of the volumetric shape. It is to be noted, however, that various other configurations to provide a sufficient volume for the reservoir are within the scope and intent of this invention.

The reservoir 22 is enclosed on all sides by walls 34 that may be integrally assembled in monolithic fashion which may be done by welding or other means or the construction may made by other means know in the art. The top 36 of reservoir 22 and the bottom 38 of reservoir 22 are open.

Two support collars 40 are centrally affixed to the front side of reservoir 22 in order to rigidly affix the reservoir 22 to the non-rotating central assembly and support means 32. The reservoir is slidably held in place on the support means 32 by fastening means 42 in the support collars 40. A flange 44 extending on the front side at the bottom of reservoir 22 provides additional bearing surface for the upper plate component 24 as hereinafter described. However, it is to be understood that the omission of the flange 44 is within the scope and intent of this invention. The assembly and support means is suitably mounted so as to be positioned over the main or base rotating canning machine.

Figure 5:
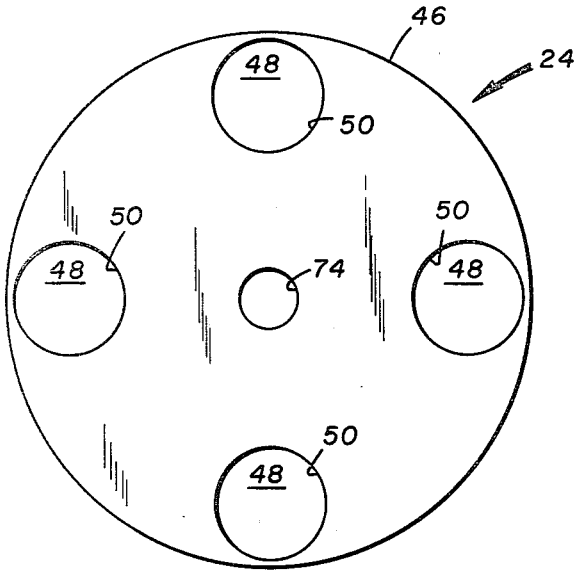
FIG. 5 is a top view of upper plate and funnel system of an apparatus for canning food.
Figure 6:
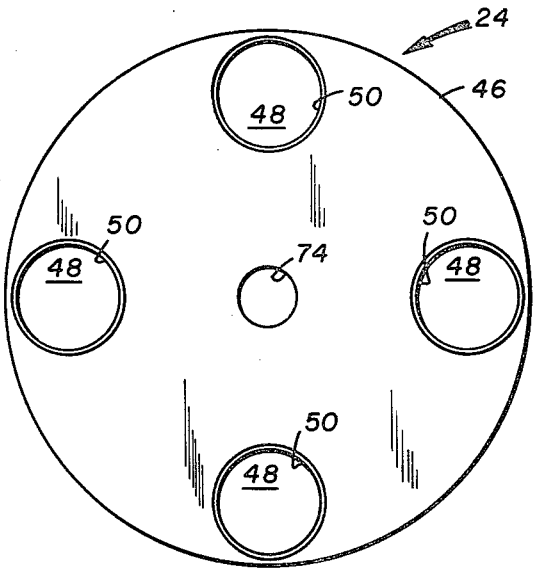
FIG. 6 is a bottom view of FIG. 5.

Referring now to FIGS. 1, 5, and 6, the upper plate and funnel system component 24 consists of an upper plate 46, having a plurality of spaced apertures 48 therein, and a plurality of spaced tube-like funnel means 50 located and affixed in each of said spaced apertures 48. It is to be understood, however, that the tube-like funnel means 50 may be set and located on the bottom side of upper plate 46 and affixed thereto so that the interior surface of said tube-like funnel means 50 is flush with the inside diameter of said spaced apertures 48 and that such arrangement is within the scope and intent of this invention.

It is to be noted that the dimensional size and configuration of the tube-like funnel means 50, and the mating elements of the lower plate and measuring and discharge component 26 (described hereinafter) can be varied to fit any size food container. As such, the components 24 and 26 may be sized and assembled for a range of food container sizes. An alternative is to use one size for the components 24 and 26 and discharge to a sub-funneling system at the container position. Any such variations are within the scope and intent of this invention.

Figure 7:
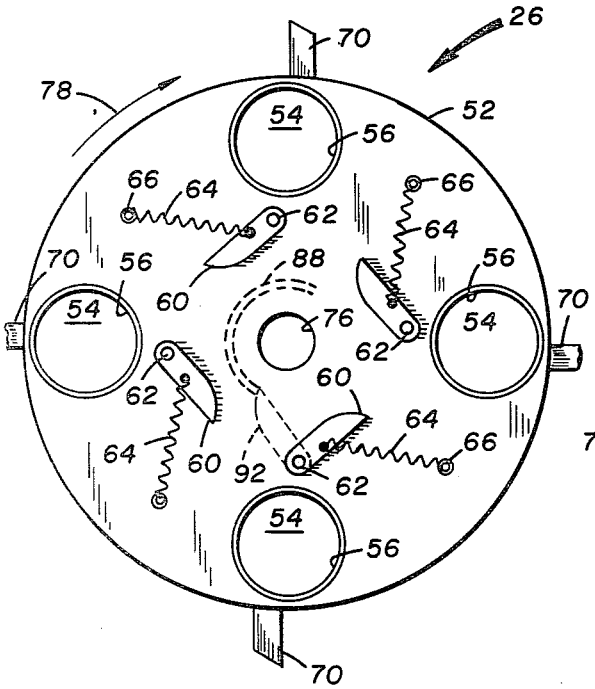
FIG. 7 is a top view of lower plate and measuring and discharge system of an apparatus for canning food.
Figure 8:
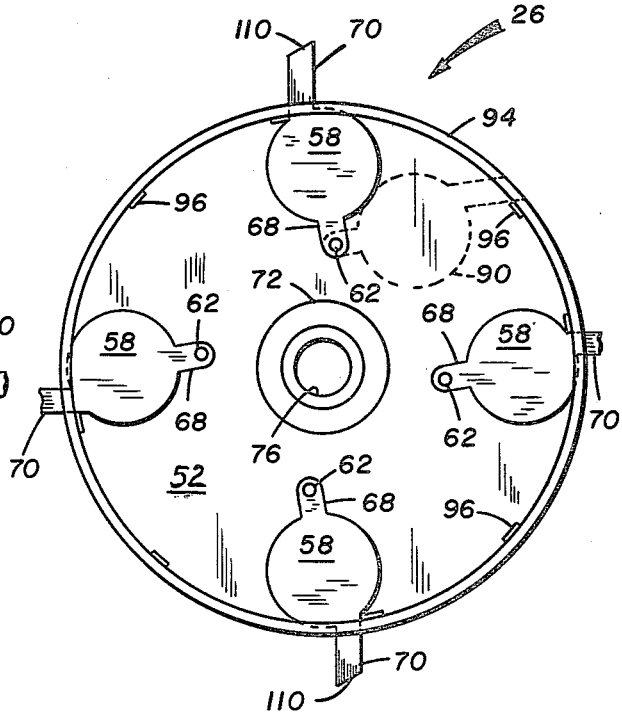
FIG. 8 is a bottom view of FIG. 7.

Referring to FIGS. 1, 7, and 8, the lower plate and measuring and discharge component 26 consists of a lower plate 52, having a plurality of spaced apertures 54, a plurality of spaced tube-like measuring means 56, and a plurality of gate discharge mechanism means described hereinafter.

The plurality of spaced tube-like measuring means 56 and the plurality of spaced tube-like funnel means 50 telescope each other. It is to be understood that either of these two elements 56 and 50 may be the inside telescoped unit within the scope and intent of this invention.

Again referring to FIG. 1, as the plurality of spaced tube-like funnel means 50 and the plurality of spaced tube-like measuring means 56 telescope, the adjustment as to the location of the two components 24 and 26 in relation to each other determines the volume enclosed within each pair of the hollow tube-like elements 50 and 56 between the outboard surfaces of the upper plate 46 and the lower plate 52. It is this adjusted enclosed volume that fills the food container selected with a measured amount of food as hereinafter described. Thus, the volume of food measured is adjustable, either by the simple adjusted position of components 24 and 26 or by a set up of a plurality of sizes of components 24 and 26 as hereinbefore described, depending upon the canning mechanism with which the present invention is used as an adjunct.

Referring to FIGS. 1, 7, and 8, each of the plurality of gate discharge mechanism means of lower plate and measuring and discharge component 26 consists of a dispensing or discharge gate 58, a safety trip arm 60, a through-pin 62 rigidly tying the discharge gate 58 and safety trip arm 60 together as a single acting unit, a tension spring 64 attached safety trip arm 60 hereafter described, and an anchor pin 66 for the tension spring 64.

Each discharge gate 58 has a connecting ear 68 and a trip arm 70, both integral and monolithic with the discharge gate 58. It is to be understood that other means of affixing the connecting ear 68 and the trip arm 70 to the discharge gate 58 are within the scope and intent of this invention.

A timing means 72 is affixed to the underside or outboard side of lower plate 52. The timing means is so formed to make connection with the exact movement of base rotary packaging unit. The drive mechanism for the apparatus for canning food 10 is not shown, but is coupled in conjunction with drive mechanism for the base rotary packaging unit to which the apparatus for canning food 10 is an adjunct device.

Upper plate 46 and lower plate 52 have centrally located apertures 74 and 76 respectively. The centrally located apertures 74 and 76 are a close fit around the central assembly and support means 32, but are not affixed to the assembly and support means 32, so that they can turn freely and smoothly. When the tube-like funnel means 50 are telescoped with tube-like measuring means 56 the power means turning the lower component 26 automatically and concurrently turns the upper component 24. The tube-like funnel means 50 and tube-like measuring means 56 slidably and removably telescope in a snug, but not binding, fit. The direction of turning of the lower component 26 is indicated by arrows 78. However, it is to be understood that movement in the opposite direction is within the scope and intent of this invention.

The tube-like measuring means 56 each project slightly below the outboard or bottom surface of lower plate 52 with the exposed end of tube-like measuring means 56 polished smooth so as to provide a good surface on which the respective discharge gate 58 can operate easily. It is to be understood that a structure in which the tube-like measuring means 56 does not project below the lower plate 52 is within the scope and intent of the present invention.

Referring to FIG. 1, the location and positioning of the lower component 26 on the central assembly means 32 is controlled by the configuration and structure of the base rotary packaging mechanism and power means to which it is an adjunct device. Once this location and positioning is determined and fixed, the other components and elements can be determined and set.

After lower component 26 is established, set, and fixed, the upper component 24 is brought into position, with the tube-like funnel means 50 and the measuring means 56 telescoping to a position to establish the exact volume to be produced by each telescoped coupling of the two tube-like means 50 and 56 to fill the food container that is to pass through the system. The upper component 24 is then set and held to the established relative position by upper plate locator and safety control component 28 being rigidly affixed to the central assembly and support means 32. A description of the top plate locator and safety control component 28 is provided hereinafter.

Figure 9:
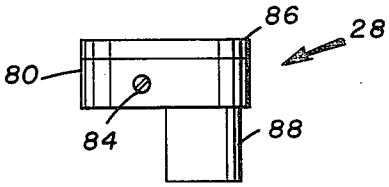
FIG. 9 is side view of upper plate locator safety control.
Figure 10:
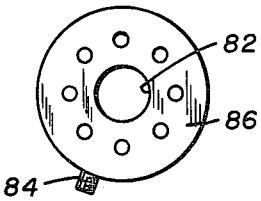
FIG. 10 is a top view of FIG. 9.
Figure 11:
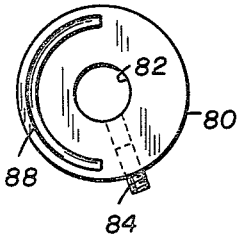
FIG. 11 is a bottom view of FIG. 9.
Figure 12:
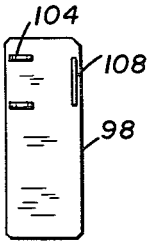
FIG. 12 is a plan view of a trigger mechanism base for an apparatus for canning food.
Figure 13:
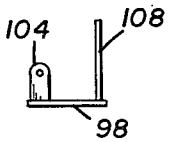
FIG. 13 is a side view of FIG. 12.
Figure 14:
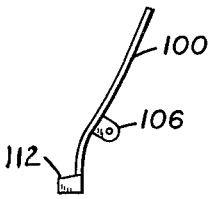
FIG. 14 is a side view of a trigger for FIG. 12.
Figure 15:
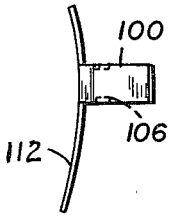
FIG. 15 is a plan view of FIG. 14.

The upper plate locator and safety control component 28 is shown in relative position to components 24 and 26 in FIG. 1, however, in FIG. 1 the components are in a separated illustration before consolidating into the operating position. The upper plate locator safety control component 28 is shown in side view in FIG. 9, top view in FIG. 10, and bottom view in FIG. 11.

The upper plate and safety control component 28 consists of cylindrical main member 80, the main member 80 having a centrally located aperture 82 which slidably and removably fits the central assembly and support means 32, a connecting means 84, such as a set screw, for rigidly affixing the main member 80 to the central assembly and support means 32, a non-metallic wear member 86 affixed to the upper most surface of main member 80, and an arc-like safety control member 88 rigidly affixed to the lower surface of main member 80.

The non-metallic wear member 86 is of a good wearing material that also furnishes a cushion-like support, such as nylon, or other similar material. The non-metallic wear member 86 serves as a bearing surface upon which the under surface of the upper plate 46 bears and slidably moves while turning during the operation. The non-metallic wear member 86 is suitably affixed to the main member 80 and may have portions removed to reduce the frictional surface area contact with the underside of upper plate 46. Any such modification is within the scope and intent of the invention.

When the component 24 is located, set and fixed in position as hereinbefore described, the reservoir 22 is lowered so that the edges of the walls 34 at the bottom opening 38 and the flange 44 rest upon the top surface of upper plate 46 in a close, neat, and snug interface. The reservoir 22 is then affixed in place by tightening the fastening means 42 in support collars 40 to the central assembly and support means 32. The interface of the edges of the walls 34 at the bottom opening 38 and flange 44 with the top surface of upper plate 46 is a slidable interface.

Turning now to the operation of the apparatus for canning food 10, the food to be canned is loaded into reservoir or hopper 22 through the open top 36. As the device operates in conjunction with the operating rotary packaging canning machine, to which it is an adjunct device, the individual telescoped combinations of a tube-like funnel means 50 and a measuring means 56 pass, in turn, under the open bottom 38 of the reservoir 22 as the components 24 and 26 turn together as described hereinbefore. As the telescoped combined tube-like means 50 and 56 pass under the open bottom 38 of reservoir 22 they each are automatically filled, by gravity flow, with the measured amount of food from the reservoir to fill one container for which the device has been set as hereinbefore described.

As the components 24 and 26 continue to turn the filled combined tube-like means 50 and 56 pass out from under the open bottom 38 of reservoir 22 and concurrently the next succeeding combined tube-like means 50 and 56 moves under the open bottom 38 of reservoir 22 for filling as the cycle continues.

As the cycle continues the filled combination of tube-like means 50 and 56 arrives at the point where the food is to be emptied or dispatched, or discharged into a sized container moving in coordinated sequence on the rotary packaging canning machine under the lower component 26. As the combined means 50 and 56 and the container come into prearranged alignment, the projecting trip arm 70 of each discharge gate 58, in turn, is operated to open the discharge gate 58 and empty or discharge the food into the container. The operation of the trip arm 70 by the trigger mechanism 30 is described hereinafter.

In the opening the discharge gate 58, the gate 58 is moved to a position 90 shown in ghost lines on FIG. 8. As the gate 58 opens to position 90 the safety trip arm 60 moves with it as they are rigidly affixed together by through pin 62; they operate together in the manner of a bell crank. As safety trip arm 60 moves it moves to a position 92 shown in ghost lines on FIG. 7 and stretches tension spring 64 to an open or tensioned position.

The discharge of the food into the container is almost instantaneous as the gate 58 opens. As the lower component 26 continues to turn the trigger mechanism 30 as hereinafter described, slides past the tapered end of trip arm 70, thus releasing it and the tension spring 64, which has been stretched into tension position, now returns to its closed position and concurrently pulls and snaps the discharge gate 58 to its closed position and readies the combined tube-like means 50 and 56 for refilling in turn.

Should a spring 64 fail, the safety trip arm 60 in position 92 slidably passes around the arc-like cam 88 and the cam action closes the gate 58 without a tension spring 64 action. The cam 88 is sized and positioned so that it closes the gate 58 at the proper moment and before the combined tube-like means 50 and 56 reach the open bottom 38 of reservoir 22.

A support ring 94, held at a proper distance from lower plate 52 by a plurality of lugs 96 supports the trip arms 70 and thus holds the discharge gate 58 tightly against the open bottom of tube-like measuring means 56 when closed. The support ring 94 also prevents wear and tear of the trigger mechanism 30 by preventing a loose interface of trip arm 70 with the trigger mechanism 30.

The through pins 62, safety trip arms 60, tension springs 64, and anchor pins 66 may be located at alternating heights from the lower plate 52 if the configuration is such that possible contact or interference of operation might occur.

The trigger mechanism component 30 in FIG. 1 may be affixed by suitable means to the main or base rotary packaging unit or to some suitable available means to position it for operation to open the discharge gates 58. The trigger mechanism component 30 consists of a base 98, a trigger arm 100, and a connecting means 102.

The trigger base 98 has a pair of lugs 104 to connect the trigger arm 100 to it with a connecting pin means 102. The trigger arm 100 has a mating pair of lugs 106 to removably connect to lugs 104. A projecting arm 108 prevents the trigger arm 100 from falling back too far. The trigger arm 100 swings freely on the connecting pin means 102 so that it can trigger the trip arm 70 and swing freely out of the way as the trigger arm 100 slides past the tapered end 110 of trip arm 70.

A curved transverse arm 112 on trigger arm 100 is activated by containers moving into place in the base rotating packaging machine below the lower component 26. The activation of transverse arm 112 assures that the trigger arm 100 is in proper position to operate the trip arm 70 as hereinbefore described.

It is to be noted that the snug fit of the tube-like means 50 and 56 must be in perfect alignment for proper operation. In adjusting the relationship of tube-like means 50 and 56 to provide predetermined volumes of food to sized food container, the limit is up to the point where sufficient telescoping of the tube-like means 50 and 56 exists to provide the snug fit and to cause the components 24 and 26 to revolve together.

Materials for the elements of this invention may be any non-corrosive and non-toxic metal, plastics, or other material that meets health rules and regulations under appropriate legal requirements.

As can be readily understood from the foregoing description of the invention, the present structure can be configured in different modes to provide the ability to measure amounts of food for discharge into containers.

Accordingly, modifications and variations to which the invention is susceptible may be practiced without departing from the scope and intent of the appended claims.

What is claimed is:

1. An apparatus for canning food, comprising:

a hopper means, said hopper means having walls therearound, said hopper means holding a supply of food to be measured into predetermined amounts for filling into containers;

a funnel system, said funnel system interfacing and communicating with said hopper means, said funnel system receiving a portion of said food from said hopper means;

a measuring system, said measuring system slidingly and removably mating telescopably with said funnel system and communicating therewith, said portion of food flowing from said funnel system into said measuring system, said measuring system having a first main plate member and a plurality of cylindrically formed tube-like measuring means, said first main plate member having a plurality of apertures therethrough to each of which is assembled and affixed one of said plurality of said cylindrically formed tube-like measuring means, the interior of each said cylindrically formed tube-like funnel means communicating with the aperture to which it is assembled, said first main plate having a centrally located aperture therethrough, said cylindrically formed tube-like measuring means projecting slightly through said first main plate member;

a dispensing system, said dispensing system being affixed to said measuring system and operating therewith, said dispensing system having a plurality of dispensing gates, each dispensing gate of said plurality of dispensing gates having an outstanding lug and a projecting trip arm extending therefrom, each of said dispensing gates being slidably and movably affixed to the underside of said first main plate member by said outstanding lug on said dispensing gate, each said dispensing gate being slidably movable across the end of said slightly projecting cylindrically formed tube-like measuring means projecting through said first main plate member, each said dispensing gate further having said projecting trip arm extending past the outside periphery of said first main plate member to operate said dispensing gate and slidably move it off said end of said projecting cylindrically formed tube-like measuring means to dispense food therefrom;

an assembly and support means, said assembly and support means being centrally located for removable assembly and support of said hopper means and for removable assembly of said funnel and measuring means, said first main plate being slidably and removably assembled to said assembly and support means through said aperture in said first main plate;

a locator means, said locator means being slidably and removably assembled and affixed to said assembly and support means between said funnel system and said measuring system, said locator means fixing spaced relationship between said funnel system and said measuring system, said spaced relationship determining amount of said portion of said food received from said hopper means and flowing into said measuring system, said locator means having a main collar member, a non-metallic member, an arc-like cam member, and an attachment means, said main collar member being centrally located on said assembly and support means, said main collar member having an aperture therethrough to fit said assembly and support means, said attachment means rigidly affixing said main collar means to said assembly and support means, said non-metallic member being affixed to the topmost side of said main collar member, and said arc-like cam member being affixed to the underside of said main member a trigger mechanism, said trigger mechanism being separately located and positioned to operate said dispensing system, and a control means, said control means being for said dispensing gate, said control means consisting of a pin member, a lever-like arm, and a tension spring, said pin member being rigidly affixed to said outstanding lug, said pin member movably projecting through said second main plate member and being rigidly affixed to said lever-like arm, said lever-like arm being connected to said tension spring member, said tension spring member being suitably anchored to said second main plate member to automatically close said dispensing gate when dispensing of food is completed, said arc-like member of said locator means controlling the operation of said lever-like arm if and when said tension spring member fails.

2. An apparatus for canning food as recited in claim 1, wherein said walls of said hopper means are enclosing walls on all sides, said enclosing walls being open at the top and at the bottom, said hopper means having means on the outside of said walls to affix said hopper means to said assembly and support means.

3. An apparatus for canning food as recited in claim 2, wherein said funnel system consists of a second main plate member and a plurality of cylindrically formed tube-like funnel means, said second main plate member having a plurality of apertures therethrough to each of which is assembled and affixed one of said plurality of said cylindrically formed tube-like funnel means, the interior of each said cylindrically formed tube-like funnel means communicating with the aperture to which it is assembled, said second main plate also having a centrally located aperture therethrough to slidably and removably fit on said assembly and support means.

4. An apparatus for canning food as recited in claim 1, wherein said assembly and support member is suitably positioned and affixed in place over and above a base rotating machine to which said apparatus for canning food is an adjunct mechanism.

5. An apparatus for canning food as recited in claim 1, wherein said trigger mechanism consists of a base member and a trigger arm, said base member and said trigger arm each having a pair of mating lugs thereon, said trigger arm being movably affixed to said base member by said pairs of mating lugs on said base member and said trigger arm and having a pin-like means to movably connect said mating lugs together, said trigger mechanism having an upstanding arm on said base to maintain said trigger arm in substantially an upright position and further, said trigger arm having a transverse member at the lower end thereof for activation by food containers to assure trigger arm is in a most vertical position to active dispensing system by pressure against said projecting trip arm.

6. An apparatus for canning food as recited in claim 1 and additionally, a circular support ring, said circular support ring being located and affixed below said measuring system second main plate member and at the periphery thereof, said circular support ring supporting each said projecting trip arm to maintain its respective dispensing gate against the projecting edge of its respective said cylindrically formed tube-like measuring means.

* * * * *